US010927495B2

(12) United States Patent
Cho

(10) Patent No.: US 10,927,495 B2
(45) Date of Patent: Feb. 23, 2021

(54) AQUEOUS STAIN RESISTANT COATED ARTIFICIAL LEATHER AND MANUFACTURING METHOD THEREFOR

(71) Applicants: Soon Kie Jung, Glen Saddle River, NJ (US); Maeng Sang Cho, Seoul (KR)

(72) Inventor: Maeng Sang Cho, Seoul (KR)

(73) Assignees: Soon Kie Jung, Glen Saddle River, NJ (US); Maeng Sang Cho, Seoul (KR)

( * ) Notice: Subject to any disclaimer, the term of this patent is extended or adjusted under 35 U.S.C. 154(b) by 0 days.

(21) Appl. No.: 16/686,745

(22) Filed: Nov. 18, 2019

(65) Prior Publication Data

US 2020/0087852 A1 Mar. 19, 2020

(30) Foreign Application Priority Data

Sep. 18, 2018 (KR) ..... 10-2018-0111243

(51) Int. Cl.
*D06N 3/00* (2006.01)
*D06N 3/14* (2006.01)

(52) U.S. Cl.
CPC ..... *D06N 3/0081* (2013.01); *D06N 3/0015* (2013.01); *D06N 3/0063* (2013.01); *D06N 3/14* (2013.01)

(58) Field of Classification Search
CPC ..... B05D 2503/00
See application file for complete search history.

(56) References Cited

U.S. PATENT DOCUMENTS 3,956,560 A * 5/1976 Smith, II ..... D04H 1/48 428/218
2003/0114542 A1* 6/2003 Mohnot ..... C09C 1/3081 516/122
2008/0254303 A1* 10/2008 Ramsey ..... C09D 7/42 428/447
2009/0047476 A1* 2/2009 Meguro ..... D06N 3/0004 428/151
2012/0029146 A1* 2/2012 Matsui ..... C08J 3/03 524/591
2013/0315575 A1* 11/2013 DeSantiago ..... H05B 3/009 392/407
2014/0162073 A1* 6/2014 Grzesiak ..... C08G 18/283 428/422.8
2014/0309345 A1* 10/2014 Frenkel ..... C08K 5/1515 524/109

FOREIGN PATENT DOCUMENTS

JP 2008-280643 A 11/2008
KR 10-2016-0076455 A 6/2016
KR 10-2017-0061667 A 6/2017

* cited by examiner

*Primary Examiner* — Dah-Wei D. Yuan
*Assistant Examiner* — Kristen A Dagenais-Englehart
(74) *Attorney, Agent, or Firm* — Sughrue Mion, PLLC

(57) ABSTRACT

The present invention relates to a method for producing an eco-friendly artificial leather by treating a polyurethane artificial leather with an aqueous stain resistant coating agent, and an aqueous stain resistant coated polyurethane artificial leather produced thereby. Without organic solvents in the stain resistant treatment process therefor, the artificial leather is eco-friendly and exhibits a uniform stain resistant effect thereacross uniformly due to the uniform and rapid drying of the stain resistant coating layer even in the absence of heating at a high temperature, and thus the coating layer is not thermally strained.

5 Claims, No Drawings

AQUEOUS STAIN RESISTANT COATED ARTIFICIAL LEATHER AND MANUFACTURING METHOD THEREFOR

BACKGROUND OF THE INVENTION

1. Field of the Invention

The present invention relates to a method for producing an eco-friendly artificial leather by treating a polyurethane artificial leather with an aqueous stain resistant coating agent, and an aqueous stain resistant coated polyurethane artificial leather produced thereby.

2. Description of the Prior Art

An artificial leather, with a microporous, three-dimensional structure formed with polyurethane resin, is soft to the touch like a natural leather and has a characteristic appearance. Artificial leathers find applications in many fields including footwear, clothing fabrics, handwear, furniture upholstery, automotive uses, and the like.

As such, many kinds of artificial leathers including nylon leather, PVC leather, and PU dry-type leather have been marketed. Artificial leathers, which are generally developed by applying a polyurethane resin or an amino-based resin alone or in a copolymer form to a woven or nonwoven backing fabric, have rapidly expanded in demand and application scope, such as in high-quality fashion materials, because of their ability to overcome the shortcomings of natural leathers, in addition to substituting for natural leathers.

Polyurethane artificial leathers are manufactured by polymerizing polyol, isocyanate, and a chain extender as raw materials for urethane in an organic solvent such as dimethyl formamide (DMF). Because an organic solvent such as dimethyl formamide is used as a reaction mediator or a diluent, the organic solvent, which is generally harmful, is released in the course of manufacture and application, causing environmental problems such as air pollution and water pollution, and resulting in a bad influence on the human body.

In addition, because solvent-based polyurethane, which is a main raw material of polyurethane artificial leathers, has tendency of being hydrolyzed upon long-term exposure to water. Furthermore, a steady increase in organic solvent costs has resulted in conventional solvent-based polyurethane being gradually substituted with aqueous polyurethane.

Aqueous polyurethane does not employ organic solvents, such as dimethyl formamide, making itself an eco-friendly material. However, aqueous polyurethane has disadvantages of weaker adhesion to the backing fabric and relatively lower mechanical properties. It also requires longer drying time during the process and storage stability is not as good as solvent based.

In order to solve those problems, Korean Patent No. 1,598,856, invented by the present inventor, discloses a method for manufacturing an aqueous polyurethane artificial leather, in which an aqueous polyurethane resin composition comprising: an aqueous polyurethane; an expandable microcapsule in the form of a shell composed of a copolymer of vinylidene chloride or acrylonitrile and having carbon dioxide contained in the core thereof; and water is impregnated into a fiber base and then cured with mid infrared ray.

In addition to being eco-friendly because of no use of volatile organic solvent, the aqueous polyurethane artificial leather can be used in substitution for conventional solvent-based polyurethane artificial leather and natural leather, providing equivalent or higher performance thanks to the excellent strength and durability thereof.

However, aqueous polyurethane artificial leather, which tends to get stained, generally requires stain resistance treatment to prevent staining. As used herein, the term "stain resistant treatment" refers to a treatment process performed for an artificial leather to prevent the surface of the leather from being smeared with dirt and to release smeared dirt.

Until now, the stain resistant treatment of artificial leather has been, for the most part, performed with solvent based stain resistant agents. Hence, although the aqueous polyurethane is made of an eco-friendly aqueous polyurethane, the aqueous polyurethane artificial leather loses its eco-friendly effect after surface treatment with a solvent based stain resistant agent. In addition, after a curing process, conventional stain resistant agents for artificial leather becomes stiff and are apt to be damaged during use.

In order to solve the encountered problems, aqueous stain resistant agents using water as a diluent are used instead of solvent based stain resistant agents using solvent based diluents such as methylethyl ketone (MEK), dimethyl formamide, etc. However, aqueous stain resistant agents have the problem of exhibiting an insufficient stain resistant effect because polymers contained in aqueous stain resistant agents are not sufficiently cured even by heating.

Korean Laid-open Publication No. 2015-0077240 A proposes a stain resistant artificial leather fabric composed of an artificial leather fabric, an adhesive layer, a functional layer, and a surface treatment layer, wherein the adhesive layer (a mixture resin of a vinyl-based resin, an acryl-based resin, a polyurethane-based resin, isocyanate, and carbodiimide) provides adhesiveness for the functional layer, the functional layer (acryl-based resin) exhibits a function such as photo-quenching, a sensation of touch, flame retardancy, etc., and the surface treatment layer is formed by applying a dispersion of silicone in a water-dispersed polyurethane solution and then drying the applied dispersion and endows the artificial leather fabric with durability and stain resistance.

In the document, the adhesive layer, the functional layer, and the surface treatment layer are sequentially formed on the artificial leather fabric so that the surface treatment layer is bound to the artificial leather fabric through the adhesive layer and the functional layer. Thus, instead of a solvent based diluent, a silicone-containing, water-dispersed polyurethane solution is used to achieve an eco-friendly stain resistant effect.

In the document, however, the surface treatment layer is merely bonded to the artificial leather surface through the adhesive layer. When the silicone-containing, water-dispersed polyurethane solution is simply dried, the polyurethane is insufficient in polymeric bonding to be cured sufficiently. Upon drying at a high temperature for a long period of time, the composition in each layer is excessively hardened so that each of the layers decreases in flexibility and is delaminated or damaged during use.

An approach to a solution to this problem is proposed in Korean Laid-open publication No. 2016-0037538 A in which a urethane prepolymer obtained by reacting diol and diisocyanate is reacted with a fluorocarbon compound having a hydroxyl functional group at each of the opposite terminals thereof to afford a fluorine-containing, modified polyurethane which is then impregnated into a nonwoven fabric to produce a suede-type artificial leather.

In the document, the fluorine group in the modified polyurethane molecule structure blocks external contaminants and increases surface tension to provide a water- and oil-repellent function, thereby suppressing the attachment of external dirt thereto. Consequently, the artificial leather can be provided with stain resistance even though the artificial leather is not additionally subjected to stain resistant treatment.

However, because the stain resistant artificial leather provides the stain resistance by reacting a diol, a diisocyanate, and a fluorocarbon compound with the main raw material urethane of artificial leather, the organic solvent for the diol and diisocyanate still has a noxious effect on the environment and the human body.

SUMMARY OF THE INVENTION

The present disclosure is to provide a method for manufacturing an aqueous, stain resistant polyurethane artificial leather, in which a polyurethane artificial leather is treated with an aqueous stain resistant agent that is then sufficiently cured without decreasing the flexibility of the artificial leather, and an aqueous, stain resistant coated polyurethane artificial leather manufactured thereby.

In order to accomplish the purpose, the present disclosure provides a method for manufacturing an aqueous, stain resistant coated polyurethane artificial leather, the method comprising the steps of: mixing 100 parts by weight of water, 20-30 parts by weight of aqueous polyurethane, and 3-7 parts by weight of silica to prepare a stain resistant solution; coating the surface of a polyurethane artificial leather with the stain resistant solution; and curing the stain resistant solution by applying infrared radiation to the stain resistant solution-coated polyurethane artificial leather.

In a particular embodiment, the stain resistant solution may be added with 0.5-3.0 parts by weight of cream on the basis of the 100 parts by weight of water, and homogenized at 1000-3000 rpm for 1-3 minutes.

In another particular embodiment, the silica may be amorphous precipitated synthetic silica and the curing step is conducted by arranging the polyurethane artificial leather for the stain resistant solution-coated surface to face upward and then applying infrared radiation.

In another particular embodiment, the curing step may be conducted by applying mid-infrared radiation having a wavelength range of 2.5-25 μm to heat the stain resistant solution-coated polyurethane artificial leather at 150-200° C. for 30-50 seconds. More particularly, mid-infrared radiation may be applied using a quartz tube heater having a carbon fiber heating wire.

Also, the present disclosure provides an aqueous stain resistant coated polyurethane artificial leather manufactured by the method.

Without organic solvents in the stain resistant treatment process therefor, the artificial leather according to the present disclosure is eco-friendly and exhibits a uniform stain resistant effect thereacross uniformly due to the uniform and rapid drying of the stain resistant coating layer even in the absence of heating at a high temperature, and thus the coating layer is not thermally strained.

DETAILED DESCRIPTION OF THE PREFERRED EMBODIMENTS

In general, an artificial leather is based mainly on polyurethane or polyvinyl chloride (PVC). For polyurethane artificial leathers, polyols, chain extenders, and isocyanates are polymerized into polyurethanes in organic solvents such as dimethyl formamide, toluene, and methyl ethyl ketone.

In order to provide functions such as stain resistance, flame retardancy, and so forth, a coating layer is formed on the surface of an artificial leather. Mostly, the coating agent is also prepared by dissolving a resin such as polyurethane in an organic solvent, as in artificial leathers, to form a binder and mixing a functional additive to the binder.

However, organic solvents for polyurethane are not completely removed even by drying and vaporization processes through thermal treatment at high temperatures because of their high boiling points and thus remain in the artificial leathers, exerting harmful influences on the human body. In addition, the thermal treatment at a high temperature strains the artificial leather or hardens the coating layer due to thermal binding.

In the present disclosure, a stain resistant solution is prepared by mixing a binder comprising aqueous polyurethane and water as a solvent with hydrophilic silica as a stain resistant agent, applied to a polyurethane artificial leather, and cured to process the polyurethane artificial leather in aqueous stain resistant treatment.

The aqueous polyurethane is a water-dispersed resin in which a water-immiscible urethane resin is emulsified with a surfactant and made stably miscible with water. The aqueous polyurethane is eco-friendly due to no use of organic solvents, has excellent strength and durability, and rapidly dries.

Silica ($SiO_2$), which is the most abundant natural resource in the globe, exhibits durability, abrasion resistance, stain resistance, chemical stability, and high-temperature stability and is not toxic to the human body. Silica is divided into crystalline silica from nature and amorphous silica synthesized artificially.

In the present disclosure, a stain resistant solution is prepared by mixing an aqueous polyurethane and silica in water. In this regard, a stain resistant solution prepared by mixing 20-30 parts by weight of an aqueous polyurethane, 3-7 parts by weight of silica, and 100 parts by weight of water can be applied at a suitable thickness to the surface of a polyurethane artificial leather and can be sufficiently dried at a proper temperature for a suitable time to prevent the polyurethane artificial leather from being deformed.

Aqueous polyurethane attracts an attention as an eco-friendly substance because of no use of organic solvents, but has tendency of forming minute bubbles on the surface of the artificial leather, often degrading the stain resistant treatment effect and the appearance of the stain resistant coated polyurethane artificial leather.

This problem can be solved by adding an anti-foaming agent, but the anti-foaming agent, which is a chemical, disrupts the chemical balance of the aqueous polyurethane to inhibit the dispersibility of the aqueous polyurethane or to disturb the curing of the aqueous polyurethane, resulting in a bad influence on the stain resistant treatment.

The addition of cream to the stain resistant solution arises as a solution to the problem. When added to the stain resistant solution, cream, which is a milk fat component with a low specific gravity, suppresses the generation of bubbles in the coating of the stain resistant solution. Cream is added in an amount of 0.5-3.0 parts by weight, based on 100 parts by weight of water and stirred at a high speed so that the cream is finely divided and dispersed in water, with the consequent conversion thereof into an emulsion.

The emulsion preparation may be preferably achieved by homogenization at 1000-3000 rpm for 1-3 minutes using a homogenizer. Since the aqueous polyurethane in the stain resistant solution retains the surfactant, the cream emulsion can remain dispersed.

Next, the stain resistant solution is applied to the surface of the polyurethane artificial leather and cured. The application of the stain resistant solution may be achieved by immersing the polyurethane artificial leather in the stain resistant solution, by spraying the stain resistant solution onto the surface of the polyurethane artificial leather, in a printing manner using a gravure mesh, or in a knife coating manner.

Typically, the curing of a coating layer formed on the surface of an artificial leather may be conducted in a high-temperature, drying manner using a heat chamber. However, an aqueous polyurethane having silica contained therein is not sufficiently cured even by a typical high-temperature drying process and thus exhibits only an insufficient stain resistant effect because of the insufficient polymeric binding thereof. Drying at a high temperature for a long period of time can afford a sufficient cured coating layer, but imparts deformation to the layer.

In detail, according to a conventional thermal chamber drying method, heat generated from a heat source is transferred to the coat of the stain resistant solution through the air with the chamber by convection and then to the inside of the coat from the surface by conduction. Thus, the entirety of the coat is dried slowly on different timetables. The difference in drying rate between the surface and the inside of the coat results in non-uniform drying across the coat.

In the present disclosure, the coat of the stain resistant solution is heated and dried in a radiation manner of applying infrared ray to the coat. The infrared ray is immediately absorbed into the stain resistant solution and converted into heat energy which, in turn, dries the stain resistant solution. When emitted, infrared energy is easy to concentrate and disperse, can be operated in a clean environment, and does not require a thermal medium. Further, because infrared energy can be directly supplied inside the stain resistant solution, the heating and dryness of the infrared energy can be rapidly achieved across the coat without heating at a high temperature, which results in a uniform stain resistant treatment effect across the coat.

Infrared ray (IR) is electromagnetic wave with wavelengths longer than those of red visible light. Infrared ray ranges in wavelength from 0.75-0.8 μm to 1 mm. Within the wavelength range, infrared ray is divided into near infrared ray (NIR) with a wavelength of 2.5 μm or shorter, mid infrared ray (MIR) with a wavelength of 2.5-25 μm, and far infrared ray (FIR) with a wavelength of 25 μm or longer.

The MIR absorption occurs as a result of the normal vibrations of many compounds. The NIR absorption is caused by overtone or harmonic molecular vibrations of the normal vibrations. The FIR absorption occurs due to the rotation of molecules.

The IR absorption of a molecule depends on vibrational or rotational changes in the dipole moment of the molecule. For example, water shows strong IR absorbance because water is a polar molecule and changes in dipole moment with the atomic vibration thereof. Thus, the MIR can effectively heat and dry the solvent water of the stain resistant solution to allow the stain resistant solution to be effectively cured.

In order to further enhance the radiation dryness efficacy of IR, carbon dioxide is preferably contained in the stain resistant solution and more preferably in the silica of the stain resistant solution before the coat is formed on the polyurethane artificial leather. In this regard, IR-induced dipole movement changes in carbon dioxide can be used to rapidly dry the stain resistant solution at relatively low temperatures.

Silica may be natural or synthetic. Synthetic silica is divided into pyrogenic silica and precipitated silica according to synthesis methods. Pyrogenic silica may be exemplified by fused silica and fumed silica and is hard with no pores therein. Fused silica and fumed silica are synthesized by melting natural sand and by gas-phase pyrolysis of silane chloride compounds, respectively.

Precipitated silica, which is in the form of nanoparticles, is produced by reacting an acid with water glass and has a spherical morphology with no micropores therein: however, many particles are aggregated or conjugated with each other by a siloxane bond to form a three-dimensional net structure with internal spaces (voids) therein.

Thus, in order to further enhance the radiation dryness efficacy of IR, amorphous precipitated synthetic silica is preferably used as the silica contained in the stain resistant solution. When carbon dioxide is supplied to the silica, the pores are filled with carbon dioxide, under which IR emission to the coat of the stain resistant solution containing the silica causes atomic vibrations, causing a change in dipole moment and thus absorbing the IR.

As described above, IR emission to the carbon dioxide-containing precipitated silica rapidly forces the water in the coat to be rapidly heated, dried, and removed by the radiation heat without increasing the drying temperature too much. IR is highly penetrative, irrespective of the distance between a light source and an object, and thus allows a stain resistant treatment process on a mass scale.

For a stain resistant solution added with cream, high-speed stirring can remove the carbon dioxide from the precipitated synthetic silica. In this regard, homogenization may be preferably conducted at 1000-3000 rpm for 1-3 minutes under a pressure of 30-100 bar using a microfludizer.

In addition, silica precipitates in water. If the time of drying the coat of the stain resistant solution is prolonged, silica precipitation occurs during the curing of the aqueous polyurethane. In this case, the silica is cured and fixed in the vicinity of the surface of the artificial leather, that is, at an inner portion of the coat of the stain resistant solution so that silica particles become rarefied on the surface of the coat, downgrading the stain resistance of the artificial leather. In contrast, if containing carbon dioxide therein, precipitated silica floats near the surface of the coat of the stain resistant solution. In this condition, when the aqueous polyurethane is cured, a lot of the precipitated synthetic silica is fixed on the surface of the coat, thus exerting stain resistance as much as possible.

Furthermore, in order to utilize the floating property of the carbon dioxide-containing precipitated synthetic silica, the artificial leather is coated with the stain resistant solution and then arranged so that the coat is positioned at the top before being dried. When both the opposite sides of the artificial leather are endowed with a stain resistant treatment, the stain resistant treatment process is sequentially conducted on one side and then on the other side, as described above.

As such, the stain resistant treating with the carbon dioxide-containing precipitated synthetic silica allows a lot of the precipitated synthetic silica to exist on the surface of the cured coat. Heating removes the carbon dioxide remaining in pores of the precipitated synthetic silica. When the stain resistant coat is smeared, dirt in the stain resistant coat can be easily removed by wiping with a wet fabric, etc. In this regard, water infiltrates into the pores to push the dirt up to the surface so that the dirt is absorbed, together with water, into the fabric.

IR heating is preferably conducted at 150-200° C. for 30-50 seconds. The heating vaporizes water, curing the polyurethane, during which the silica particles are dispersed and fixed across the aqueous polyurethane to impart stain resistance and water and oil repellency. When a coat is formed with carbon dioxide-containing precipitated synthetic silica, the polyurethane can be sufficiently cured even though the heating time is reduced.

In IR heating, it is important to select a proper wavelength with which the emission energy is converted into heat in the target. Water, aqueous polyurethane, and silica, which are the components of the resin composition, show strong absorbance and excellent energy transfer properties in the mid IR wavelength region. Thus, mid IR is preferably used as a heating means in the present disclosure.

When employing mid IR, excellent drying efficiency can be obtained and the necessary facility space is small. In addition, since the drying is conducted at high rate and efficiency using only the effective wavelength band, the required energy can be reduced. Heat transfer through radiation is faster than that through convection. Thus, the IR heating, which is a kind of heat transfer through radiation, can reduce the drying section to less than half thereof. The IR heating is of a direct manner and thus can also obtain the same effect as in hot-air drying even at a low temperature. Consequently, the IR heating can prevent the coat of the stain resistant solution from being thermally deformed.

A quartz tube heater is preferably used as a mid IR emitter. During operation, quartz tube heaters are low in temperature on the surfaces thereof, but can increase the surface temperature of a target at high efficiency. Although quartz tube heaters typically employ a nickel-chrome heating wire as a pyrogen, a carbon fiber heating wire is preferred because it is the best in terms of mid-IR emission and thermal efficiency and reduces a drying time, thus preventing the thermal deformation of the coat.

Hereinafter, examples of the present disclosure will be described in detail. However, these examples are given for specifically illustrating the present disclosure, and the scope of the present disclosure is not limited thereto.

EXAMPLE 1

A stain resistant solution was prepared by mixing 2.5 kg of aqueous polyurethane and 500 g of silica fume in 10 kg of water and then applied to one side of an aqueous polyurethane artificial leather at an area density of 40 g/m$^2$.

The aqueous polyurethane artificial leather was arranged to allow the stain resistant solution-coated side to face upward on the conveyer belt of a mid-IR drying system (MS 9108 H, DTX, Korea) before the operation of the drying system. Mid IR with a wavelength of 7 μm was used to heat the stain resistant solution-coated polyurethane artificial leather at 185° C. for 40 seconds to accomplish the aqueous stain resistant treatment.

EXAMPLE 2

A polyurethane artificial leather was provided with an aqueous stain resistant treatment in the same manner as in Example 1, with the exception that 100 g of cream was added upon the preparation of the stain resistant solution and homogenized at 2000 rpm for 2 minutes using a homogenizer (T.K. Homomixer Mark II Model 2.5, PRIMIX, Japan).

EXAMPLE 3

Carbon dioxide was fed under pressure into amorphous precipitated synthetic silica having pores so that the synthetic silica contained carbon dioxide therein. In 10 kg of water, 2.5 kg of aqueous polyurethane was mixed with 500 g of the carbon dioxide-containing amorphous precipitated synthetic silica to prepare a stain resistant solution which was then applied at an area density of 40 g/m$^2$ to one side of an aqueous polyurethane artificial leather.

The aqueous polyurethane artificial leather was arranged to allow the stain resistant solution-coated side to face upward on a conveyer belt which was then run through a chamber internally equipped with a quartz tube heater employing a carbon fiber heating wire as a pyrogen. While the aqueous polyurethane artificial leather passed through chamber, the quartz tube heater emitted mid-IR with a wavelength of 7 μm to heat the aqueous polyurethane artificial leather at 185° C. for 30 seconds, thereby providing an aqueous stain resistant treatment for the leather.

COMPARATIVE EXAMPLES 1 AND 2

A polyurethane artificial leather was provided with an aqueous stain resistant treatment in the same manner as in Example 1, with the exception that the polyurethane artificial leather was heated at 185° C. for seconds (Comparative Example 1) and 60 seconds (Comparative Example 2) by a hot-air drying chamber, instead of the mid-IR drying system, with the stain resistant solution-coated side facing upward.

TEST EXAMPLE 1: Test for Stain Resistance

Each of specimens from the aqueous stain resistant coated polyurethane artificial leathers in Examples 1-3 and Comparative Examples 1 and 2 was evaluated for stain resistance according to the Stain Release Management Performance Test Method of the AATCC (American Association of Textile Chemists and Colorists).

Each of the specimens was spread over a blotting paper laid horizontally, and 5 drops of engine oil liquid containing 0.1 mass % of carbon black and 5 drops of corn oil were added to the specimen. A glassine paper was laid over the test specimen, and a weight (2.27 kg) was further loaded on the glassine paper. This state was maintained for 60 seconds. Thereafter, the weight and the glassine paper were removed.

The test specimen was left to stand at a room temperature for 15 minutes. Then, a ballast cloth was added to the test specimen so that the total weight could be 1.8 kg. The test cloth and the ballast cloth were washed at a bath temperature of 35° C. in a washing machine with a capacity of 64 L, using 100 g of a WOB detergent of AATCC standard. The test specimen was dried in a tumbler drier of AATCC standard.

The conditions of the remaining soils on the dried test specimen were compared with standard photographic plates so as to determine a corresponding criterion which indicates the soil release performance (see Table 1, below). The standard photographic plates used for evaluation were in accordance with AATCC-TM 130-2000.

TABLE 1

Criteria for Soil Releasability

| Level | Criterion |
|---|---|
| 0 | Soils not removed at all |
| 1 | Soils almost not removed |
| 2 | Soils removed, but with the outlines thereof remaining clear |

TABLE 1-continued

| Criteria for Soil Releasability | |
|---|---|
| Level | Criterion |
| 3 | Soils slightly remain although the outlines remaining unclear |
| 4 | Soils not completely removed, but slightly remains |
| 5 | No soil remains |

The test results are given in Table 2, below.

TABLE 2

| Measurement Results of Stain Resistance | | |
|---|---|---|
| | Engine Oil | Corn Oil |
| Example 1 | 4-5 | 5 |
| Example 2 | 4-5 | 4-5 |
| Example 3 | 5 | 5 |
| Comparative Example 1 | 2-3 | 2 |
| Comparative Example 2 | 4 | 4-5 |

As shown in Table 2, the aqueous polyurethane artificial leathers of the Examples exhibited excellent soil releasability with the solid release performance at level 4 or higher wherein the aqueous polyurethane artificial leather of Comparative Example 1, which was dried at 185° C. for 40 seconds with hot air, was measured to be in level 3 or lower, which accounts for an insufficient stain resistant effect of the coat of the stain resistant solution because the stain resistant solution was not sufficiently cured.

For the aqueous polyurethane artificial leather of Comparative Example 2, which was dried at 185° C. for 60 seconds with hot air, the soil release performance was measured to be excellent with level 4 or higher, but the artificial leather had a rough coating surface and was slightly deformed and defective due to the overheating.

As described above, after the polyurethane artificial leather was coated with a mixture of aqueous polyurethane and silica in water, radiation heat transfer rapidly and uniformly dries the coat of the stain resistant solution, compared to convection or conduction heat transfer, guaranteeing that the aqueous stain resistant coated polyurethane artificial leather has excellent stain resistance and is not deformed.

TEST EXAMPLE 2: Water Absorptivity

Specimens from the aqueous stain resistant polyurethane artificial leathers prepared in the Examples and the Comparative Examples were left for 1 and 3 hours in a constant temperature and humidity incubator (temperature 20±2° C., humidity 95±2% RH) and then measured for water absorptivity. The results are given in Table 3, below. Water absorptivity was calculated according to the following formula:

Water absorptivity (%)=(specimen weight after incubation−specimen weight before incubation)/specimen weight before incubation×100

TABLE 3

| Measurement Results of Water Absorptivity (%) | | |
|---|---|---|
| | After 1 hour | After 3 hours |
| Example 1 | 1.1 | 1.7 |
| Example 2 | 1.0 | 1.5 |
| Example 3 | 1.5 | 2.4 |
| Comparative Example 1 | 1.2 | 2.1 |
| Comparative Example 2 | 1.1 | 1.3 |

As shown in Table 3, the highest water absorptivity was detected in Example 3. The IR radiation heating in the stain resistant treatment process removed carbon dioxide from pores of the amorphous precipitated synthetic silica and water is absorbed into the vacant pores, resulting in an increase in water absorptivity. Given high water absorptivity, the polyurethane artificial leather becomes flexible as well as being advantageous in terms of stain resistance because soils on the polyurethane artificial leather can be easily removed along with water.

Comparative Example 1, which was dried at 185° C. for 40 seconds with hot air, also exhibited relatively high water absorptivity. However, this result is not preferred because the uncured aqueous polyurethane was low in stain resistance and scratch resistance although becoming flexible due to water absorption.

In addition, higher water absorptivity was detected in the Examples than that in Comparative Example 2, indicating that IR drying is advantageous over hot air curing in terms of improving the stain resistance and flexibility of the artificial leather because the stain resistant solution further increases in water absorptivity when it is cured by IR drying rather than hot air curing.

What is claimed is:

1. A method for manufacturing an aqueous stain resistant coated polyurethane artificial leather, the method comprising the steps of:

mixing 20 to 30 parts by weight of aqueous polyurethane, 3 to 7 parts by weight of silica, 0.5 to 3.0 parts by weight of cream, and 100 parts by weight of the water and homogenizing the resulting mixture at 1000-3000 rpm for 1 to 3 minutes to prepare a stain resistant solution;

coating a surface of a polyurethane artificial leather with the stain resistant solution; and curing the coat of the stain resistant solution by irradiating the polyurethane artificial leather coated with the stain resistant solution with infrared rays.

2. The method of claim 1, wherein the silica is carbon dioxide-containing amorphous precipitated synthetic silica.

3. The method of claim 2, wherein the curing step is conducted by arranging the polyurethane artificial leather for the stain resistant solution-coated surface to face upward and then irradiating the surface with infrared rays.

4. The method of claim 1, wherein the curing step is conducted by irradiating the stain resistant solution-coated polyurethane artificial leather with mid-infrared rays having a wavelength range of 2.5-25 μm to heat the polyurethane artificial leather at 150-200° C. for 30-50 seconds.

5. The method of claim 4, wherein the mid-infrared ray is emitted using a quartz tube heater having a carbon fiber heating wire.

* * * * *